US006514350B1

(12) United States Patent
Libutti et al.

(10) Patent No.: US 6,514,350 B1
(45) Date of Patent: Feb. 4, 2003

(54) PROCESS FOR REMOVING RUST FROM METAL SURFACES

(75) Inventors: Bruce L. Libutti, Teaneck, NJ (US); Joseph Mihelic, Sparta, NJ (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/952,489

(22) Filed: Sep. 14, 2001

Related U.S. Application Data

(60) Provisional application No. 60/232,692, filed on Sep. 15, 2000.

(51) Int. Cl.[7] ..... C23G 1/00

(52) U.S. Cl. ..... 134/2; 134/3; 134/22.1; 134/22.14; 134/22.19; 134/34; 134/36; 134/41; 134/42; 510/247; 510/254; 510/255; 510/437; 510/488; 510/491

(58) Field of Search ..... 134/2, 3, 22.1, 134/22.14, 22.19, 34, 36, 41, 42; 510/247, 254, 255, 437, 488, 491

(56) References Cited

U.S. PATENT DOCUMENTS

| | | | | | |
|---|---|---|---|---|---|
| 2,509,197 | A | * | 5/1950 | Borus et al. | 510/204 |
| 3,148,150 | A | * | 9/1964 | De Groote et al. | 134/42 |
| 3,510,432 | A | * | 5/1970 | Squire | 134/3 |
| 4,029,577 | A | * | 6/1977 | Godlewski et al. | 210/701 |
| 4,637,899 | A | * | 1/1987 | Kennedy, Jr. et al. | 252/391 |
| 5,271,141 | A | | 12/1993 | Vincent | 29/456 |
| 5,415,896 | A | * | 5/1995 | Mulvihill et al. | 134/2 |
| 5,653,917 | A | * | 8/1997 | Singerman | 134/3 |
| 5,854,145 | A | * | 12/1998 | Chandler et al. | 106/14.13 |
| 6,156,129 | A | * | 12/2000 | Hlivka et al. | 134/42 |
| 6,187,737 | B1 | * | 2/2001 | Geke et al. | 510/245 |

FOREIGN PATENT DOCUMENTS

JP 410140378 A * 5/1998

* cited by examiner

*Primary Examiner*—Sharidan Carrillo
(74) *Attorney, Agent, or Firm*—David L. Hedden

(57) ABSTRACT

This invention relates to a process for removing rust from metal surfaces. The process uses an aqueous solution of a benzoate.

7 Claims, No Drawings

PROCESS FOR REMOVING RUST FROM METAL SURFACES

CROSS-REFERENCE TO RELATED APPLICATIONS

This application claims the benefit of U.S. provisional application serial No. 60/232,692 filed on Sep. 15, 2000, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to a process for removing rust from metal surfaces. The process uses an aqueous solution of a benzoate.

(2) Description of the Related Art

Steel equipment, for example tanks and heat exchangers, often are placed in storage for extended periods when they are not in use. During the time they are stored, a light rust layer can form on the metal surfaces of such equipment, particularly the internal surfaces when the surface is exposed to moisture. This can cause problems later, such as localized corrosion due to concentration cells created by the by the restricted access of oxygen to the steel surface under the rust; particulate fouling, if the rust is suspended in water; or reduced efficiency of corrosion inhibitors subsequently applied after storage, when the equipment is used.

It is known that vapor phase corrosion inhibitors protect steel from corroding during shipping and storage. See for instance U.S. Pat. Nos. 2,643,177; 3,779,818; 5,271,141 and "Kirk-Othmer Encyclopedia of Chemical Technology", Vol. 7, pp. 137–138. These inhibitors produce a vapor, which precipitates a thin film that is adsorbed on exposed surfaces and protects the surface from corrosion. Examples of such vapor phase inhibitors include amine salts of nitrous acid; amine salts of carbonic, carbamic, acetic and substituted or unsubstituted benzoic acids; organic esters of nitrous, phthalic or carbonic acids; primary, secondary and tertiary aliphatic amines, cycloaliphatic and aromatic amines, polymethylene amines; mixtures of nitrites with urea and ethanolamines; anitrobenzene; and 1-nitronaphthalene.

Two common vapor phase corrosion inhibitors are dicyclohexylamine nitrite and cyclohexylamine carbonate. However, both of these inhibitors are somewhat toxic, and the former presents a fire hazard. Various non-toxic proprietary compositions have been produced and are preferred for corrosion protection based on performance and safety.

The vapor phase inhibitors are typically used neat, but many of them will continue to provide some corrosion control when dissolved in water. Generally, however, when the surface to be protected is immersed in water, as in steel tanks or boiler tubes, liquid phase inhibitors, such as the water soluble inorganic and organic salts which create a passive surface on the metal, are used. Such liquid phase corrosion inhibitors are disclosed, for example, in U.S. Pat. No. 2,550,997, and include the nitrite salts of alkali metals; alkaline earth metals; and aromatic, aliphatic and heterocyclic amines, which are not subject to auto-decomposition at ambient temperature.

Benzoic acid and its salts, such as ammonium benzoate, sodium benzoate, potassium benzoate, sodium nitrate, and potassium nitrate also effective liquid phase inhibitors. Ammonium benzoate is a material that functions both as a contact inhibitor for surfaces immersed in its water solution and a volatile corrosion inhibitor, protecting the water-air interface and surfaces surrounding the vapor space. Because of cost factors and availability, benzoates are generally preferred as corrosion inhibitors. Although it is known that benzoates prevent corrosion, it is not known that it can be used to remove rust from metal surfaces.

On the other hand, there are numerous chemical agents used to remove products of corrosion. These agents include acids, e.g. hydrochloric and sulfamic acids; chelants, e.g. EDTA; and sequestering agents, e.g. citric acid. However, the use of these agents has disadvantages. For instance, they may require post-passivation, and at a minimum, they require handling and the inventory of an additional chemical.

All citations referred to under this description of the "Related Art" and in the "Detailed Description of the Invention" are expressly incorporated by reference.

BRIEF SUMMARY OF THE INVENTION

This invention relates to a process for removing rust from metal surfaces. The process comprises:

(a) contacting a metal surface containing rust with an aqueous solution of a benzoate;

(b) maintaining contact with said metal surface until the rust is partially or totally removed from the metal surface.

Preferably, the aqueous solution of benzoate is reapplied to the metal surface once the rust is removed to prevent rust from forming again.

The process is particularly useful when applied to the internal surfaces of equipment, made of steel, that is exposed to moisture, particularly if the layer of rust is slight. The process is inexpensive and does not require additional passivation.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

For purposes if this invention, rust is defined as hydrated iron oxide. Rust is known to form on metal surfaces, particularly steel, when exposed to moisture.

A benzoate is defined as a salt of benzoic acid. Examples of benzoates that can be used in the process include ammonium benzoate, amine benzoates, sodium benzoate, and potassium benzoate. Preferably used are ammonium benzoate and amine benzoates. Examples of amines that can be used to form the amine benzoates include aliphatic amines and alkanolamines. Specific examples include cyclohexylamine, dicyclohexylamine, diisopropylamine, and diisobutylamine; monoethanolamine, diethanolamine, and triethanolamine; and morpholine. Most preferably used as the benzoate is ammonium benzoate.

The benzoates are used in an effective rust-removing amount in the aqueous solution. Typically the amount of benzoate used in the aqueous solutions from 0.05 to 1.0 weight percent of the solution is a benzoate, preferably from 0.2 to 0.75 weight percent, where the weight percent is based upon the total weight of the aqueous solution.

The metal surface to be treated is brought into contact with the aqueous solution, preferably by immersing the metal surface in the aqueous solution, most preferably totally immersing it in the aqueous solution. The length of time need to remove the rust from the surface depends upon the degree of corrosion. Typically, the time for immersion is from 7 to 120 days, preferably from 30 to 90 days. The metal surface treated is typically steel and is the internal surface of equipment such as boilers, boiler tubes, tanks, heat exchangers, reactors, and the like.

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated.

In order to test the effectiveness of the process described herein, C1010 mild steel coupons, having an average rust deposit weight of approximately 2.0 grams per square decimeter, were fully immersed in 200 ml solution of deionized water (Control A) or a solution of ammonium benzoate in water (ABS) (Examples 1–2) for 83 days at a temperature of ~24° C. to determine whether and how much rust was removed by the process. The solutions were gently swirled every other week. The results are summarized in Table I.

TABLE I (Cleaning of Pre-rusted Coupons)

| Test | Treatment Solution | Observations after 83 days of immersion |
|---|---|---|
| A | Blank deionized water | The water was rusty in appearance and the 1010 coupon was covered with orange/brown rust, edges black. |
| 1 | 2500 ppm ABS | The water was rusty in appearance, but the C1010 coupon was clean coupon with no rust visible. |
| 2 | 5000 ppm ABS | The water was rusty in appearance, but the C1010 coupon was clean with no rust visible. |

The data in Table I indicate that the process of this invention is effective at removing rust from the metal surface of steel.

In Example 3, the ammonium benzoate solution was added to the treated, cleaned coupon of Example 2. The results are summarized in Table II.

TABLE II (Post-cleaning Corrosion Protection)

| Test | Treatment Solution | Corrosion rate (MPY) | Observations after 55 days of immersion |
|---|---|---|---|
| 3 | The treated test coupon from Example 2 was immersed in 5000 PPM of ABS. | 0.006 MPY | No new corrosion was visible on the old/cleaned C1010 coupon. The test solution was clean and there was no evidence of iron precipitate. |

The data in Table II indicate that the treated, cleaned coupon, which had the rust removed, could be protected from further corrosion by subsequent re-treatment with the ammonium benzoate solution.

What is claimed is:

1. A process for removing rust from metal surfaces comprising:

(a) contacting a metal surface containing rust with an aqueous solution consisting of water and 0.05 to 1.0 weight percent of a benzoate selected from the group consisting of ammonium benzoate, amine benzoates, alkali metal benzoates, and mixtures thereof, wherein said weight percent is based upon the weight of said aqueous solution;

(b) maintaining contact with said metal surface until the rust is partially or totally removed from the metal surface.

2. The process of claim 1 wherein the metal surface is steel.

3. The process of claim 2 wherein the steel is in contact with moisture.

4. The process of claim 3 wherein the steel surface is in contact with the moisture prior to the application of the aqueous solution of the benzoate.

5. The process of claim 4 wherein the benzoate is selected from the group consisting of ammonium benzoate, amine benzoates, and mixtures thereof.

6. The process of claim 5 wherein the benzoate is an aqueous solution of ammonium benzoate.

7. The process of claim 6 wherein the metal surface is in contact with the aqueous solution of ammonium benzoate for 30 days to 90 days.

* * * * *